US005116152A

United States Patent [19]

Caswell

[11] Patent Number: 5,116,152

[45] Date of Patent: May 26, 1992

[54] FLUID NOZZLE AND SCRAPER APPARATUS

[76] Inventor: Warren E. Caswell, 2881 Townline Rd., Madison, Ohio 44057

[21] Appl. No.: 612,545

[22] Filed: Nov. 13, 1990

[51] Int. Cl.[5] ..... A47L 13/03

[52] U.S. Cl. ..... 401/261; 239/511; 401/139; 401/263; 401/266

[58] Field of Search ..... 401/139, 261, 263, 266, 401/195; 239/289, 511

[56] References Cited

U.S. PATENT DOCUMENTS

| | | | |
|---|---|---|---|
| 357,799 | 2/1887 | Wainwright | 239/511 |
| 1,142,811 | 6/1915 | Griswold | 401/263 |
| 1,456,786 | 5/1923 | De Luca | 401/195 X |
| 1,598,811 | 9/1926 | Ferrin | 401/263 |
| 1,815,535 | 7/1931 | Weitzel | 239/511 X |
| 2,141,061 | 12/1938 | Dodson | 401/195 X |
| 2,298,765 | 10/1942 | Johnson | 239/511 |
| 3,143,984 | 8/1964 | Morasch | 401/263 X |

FOREIGN PATENT DOCUMENTS

| | | | |
|---|---|---|---|
| 1045763 | 1/1979 | Canada | 401/261 |

*Primary Examiner*—Steven A. Bratlie
*Attorney, Agent, or Firm*—Leon Gilden

[57] ABSTRACT

An apparatus wherein a fluid nozzle is arranged with a valve figure to effect fluid flow through the nozzle, wherein the nozzle includes a scraper blade mounted within the housing to permit reciprocation of the scraper blade from a first position contained within the housing to a second position extended relative to the housing positioned forwardly of the nozzle to permit simultaneous scraping and cleaning. A modification of the invention further includes an overlying deflective plate adjustably mounted to enhance spray dispersion of fluid directed from the nozzle.

1 Claim, 4 Drawing Sheets

10
12
12a
13
11
14
15
16
17
5
5

12
14
15
17

FLUID NOZZLE AND SCRAPER APPARATUS

BACKGROUND OF THE INVENTION

1. Field of the Invention

The field of invention relates to fluid nozzle apparatus, and more particularly pertains to a new and improved fluid nozzle and scraper apparatus wherein the same permits simultaneous scraping of a surface during fluid flow through the nozzle.

2. Description of the Prior Art

Various nozzle structure has been set forth in the prior art to effect directing of fluid in a predetermined orientation permitting a cleaning operation in use therewith. Such prior art is found in U.S. Pat. No. 4,812,070 to Marty wherein a spray nozzle fixedly mounts a brush member thereabout in a circumferential relationship, with a scraper attachment positioned medially of the brush member to permit scraping simultaneously, wherein the scraper blade is in a fixed non-adjustable orientation relative to the brush structure.

U.S. Pat. No. 4,742,592 to Addona, Sr. sets forth a hydrofoil attached to a long handled swimming pool brush at a fixed angle that forces the brush against the pool wall in a forward stroke to enhance cleaning of the pool wall.

U.S. Pat. No. 3,036,190 to Johnson provides for a paint and varnish scraper in cooperation with a heater in advance of the blade to enhance scraping of various coatings from a surface.

U.S. Pat. No. 3,673,383 to Sofia sets forth a further example of a scraping tool electrically heated to enhance a scraping procedure.

As such, it may be appreciated that there continues to be a need for a new and improved fluid nozzle and scraper apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of scraper apparatus now present in the prior art, the present invention provides a fluid nozzle and scraper apparatus wherein the same permits fluid flow to a nozzle and selective extension of a scraper blade underlying the nozzle to permit scraping at an underlying relationship relative to fluid flow from the nozzle to avoid impeding of fluid flow therethrough. As such, the general purpose of the present invention, which will be described subsequently in greater detail, is to provide a new and improved fluid nozzle and scraping appartus which has all the advantages of the prior art fluid flow apparatus and none of the disadvantages.

To attain this, the present invention provides an apparatus wherein a fluid nozzle is arranged with a valve figure to effect fluid flow through the nozzle, wherein the nozzle includes a scraper blade mounted within the housing to permit reciprocation of the scraper blade from a first position contained within the housing to a second position extended relative to the housing positioned forwardly of the nozzle to permit simultaneous scraping and cleaning. A modification of the invention further includes an overlying deflective plate adjustably mounted to enhance spray dispersion of fluid directed from the nozzle.

My invention resides not in any one of these features per se, but rather in the particular combination of all of them herein disclosed and claimed and it is distinguished from the prior art in this particular combination of all of its structures for the functions specified.

There has thus been outlines, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention. It is therefore an object of the present invention to provide a new and improved fluid nozzle and scraper apparatus which has all the advantages of the prior art fluid flow apparatus and none of the disadvantages.

It is another object of the present invention to provide a new and improved fluid nozzle and scraper apparatus which may be easily and efficiently manufactured and marketed.

It is a further object of the present invention to provide a new and improved fluid nozzle and scraper apparatus which is of a durable and reliable construction.

An even further object of the present invention is to provide a new and improved fluid nozzle and scraper apparatus which is susceptible of a low cost of manufacture with regard to both materials and labor, and which accordingly is then susceptible of low prices of sale to the consuming public, thereby making such fluid nozzle and scraper apparatus economically available to the buying public.

Still yet another object of the present invention is to provide a new and improved fluid nozzle and scraper apparatus which provides in the apparatuses and methods of the prior art some of the advantages thereof, while simultaneously overcoming some of the disadvantages normally associated therewith.

Still another object of the present invention is to provide a new and improved fluid nozzle and scraper apparatus wherein the same permits selective scraping in cooperation with a fluid nozzle and further permits the selection and fanning of spray overlying a scraping surface to enhance cleaning of the surface during a scraping procedure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an isometric illustration of the modified invention setting forth the deflector plate and its orientation relative to the nozzle.

DESCRIPTION OF THE PREFERRED EMBODIMENT

Figure 1:
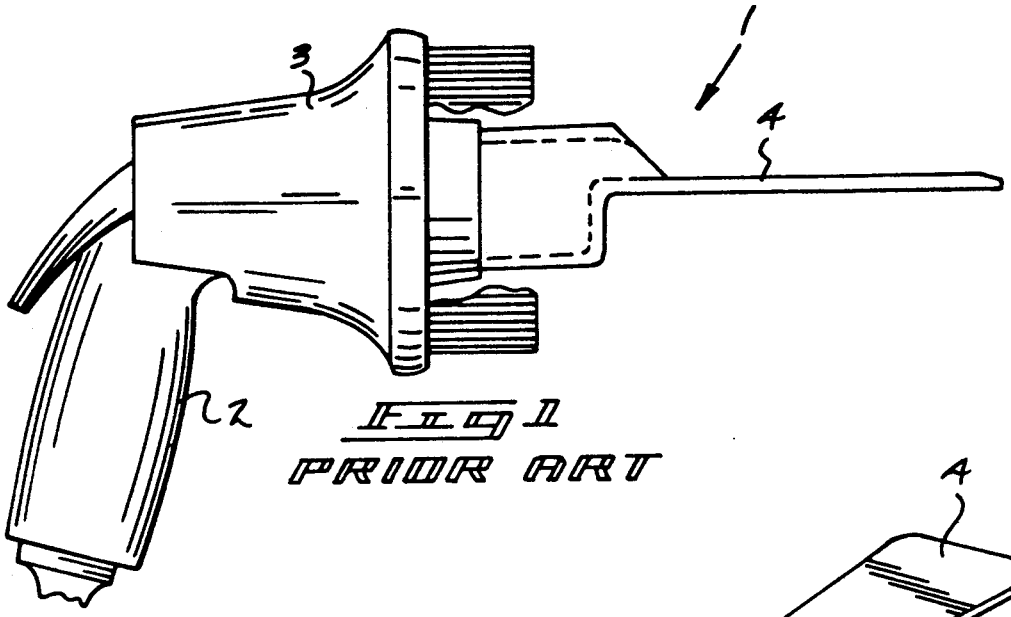
Fig 1 PRIOR ART
FIG. 1 is an orthographic side view, taken in elevation, of a prior art fluid nozzle and scraper organization.
Figure 2:
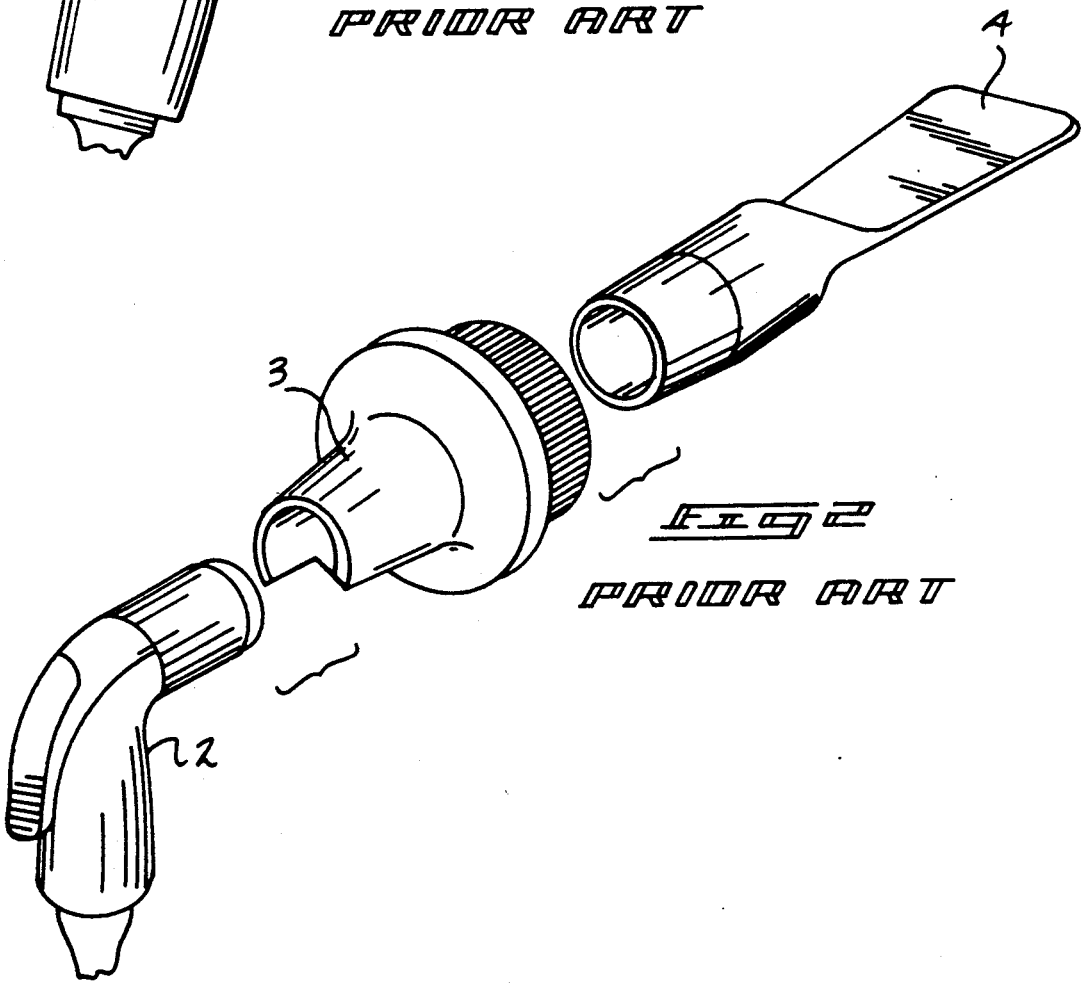
Fig 2 PRIOR ART
FIG. 2 is an isometric illustration, in an exploded view of the scraper apparatus as set forth in FIG. 1.
Figure 3:
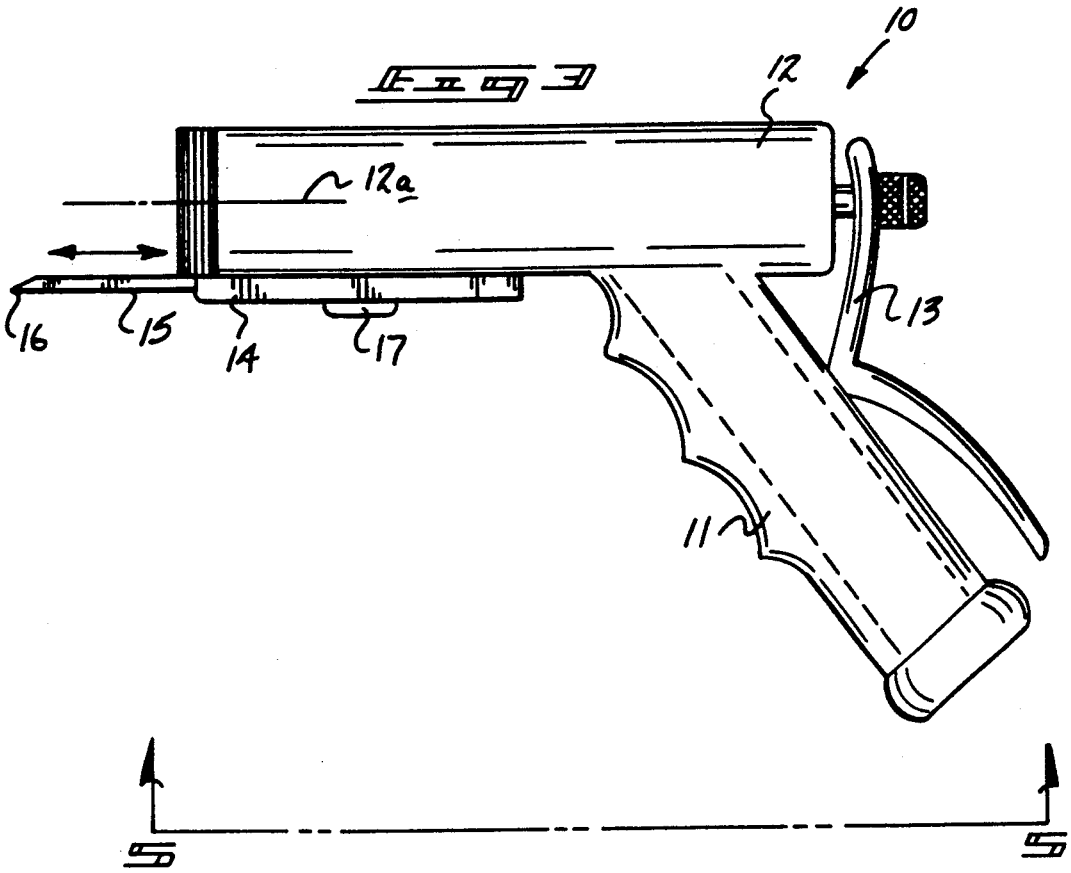
FIG. 3 is an orthographic side view, taken in elevation, of the instant invention.
Figure 4:
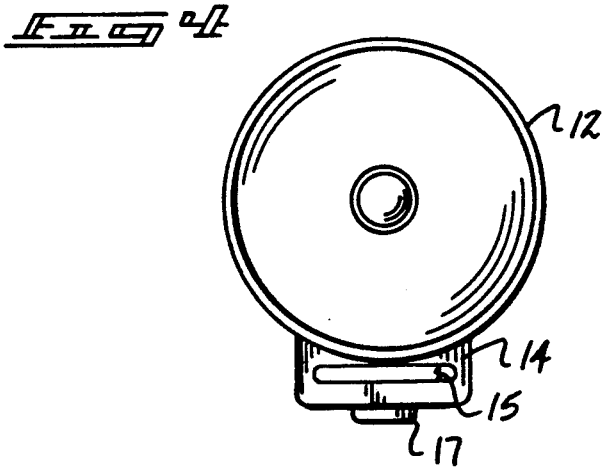
FIG. 4 is an orthographic front view, taken in elevation, of the instant invention.
Figure 5:
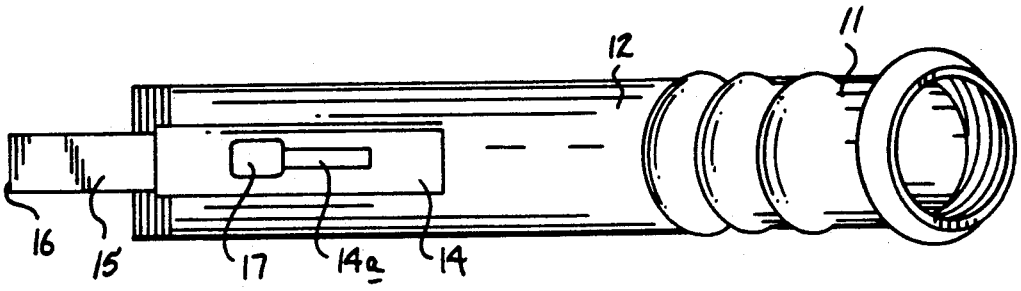
FIG. 5 is an orthographic view, taken along the lines 5—5 of FIG. 3 in the direction indicated by the arrows.

With reference now to the drawings, and in particular to FIGS. 1 to 7 thereof, a new and improved fluid nozzle and scraper apparatus embodying the principles and concepts of the present invention and generally designated by the reference numeral 10 will be described.

FIG. 1 illustrates a prior art fluid nozzle and scraper apparatus 1, wherein a conventional kitchen nozzle 2 mounts a brush 3 circumferentially thereabout, with the bristle extending coaxially parallel to the nozzle, with a scraper 4 mounted coaxially aligned with the brush and outlet port of the nozzle, in a manner as set forth in U.S. Pat. No. 4,812,070.

More specifically, the fluid nozzle and scraper apparatus 10 of the instant invention essentially comprises a nozzle assembly including a handle 11, with a fluid conduit directed coaxially through the handle, with the handle 11 and its conduit in fluid communication with another coaxially aligned fluid conduit 12, wherein the upper fluid conduit 12 is arranged at an oblique angle relative to the handle 11. A lever valve 13 is mounted in cooperative relationship with the handle 11 to effect fluid flow through the fluid conduit 12. A slide housing 14 is mounted to a bottom surface of the upper fluid conduit 12 adjacent the forward terminal end thereof, wherein the slide housing 14 includes a slide blade 15 reciprocatably mounted relative to the slide housing 14 to permit reciprocation from a first position retracted completely within the slide housing 14 to a second position extended forwardly, wherein a forward chisel end 16 of the blade 15 extends coaxially parallel relative to the upper conduit axis 12*a* and forwardly of the forward terminal end of the upper fluid conduit 12. A blade button 17 projecting through the housing 14 and overlying a slide housing 14*a* (see FIG. 5) permits reciprocation of the blade 15, as noted above.

Figure 6:
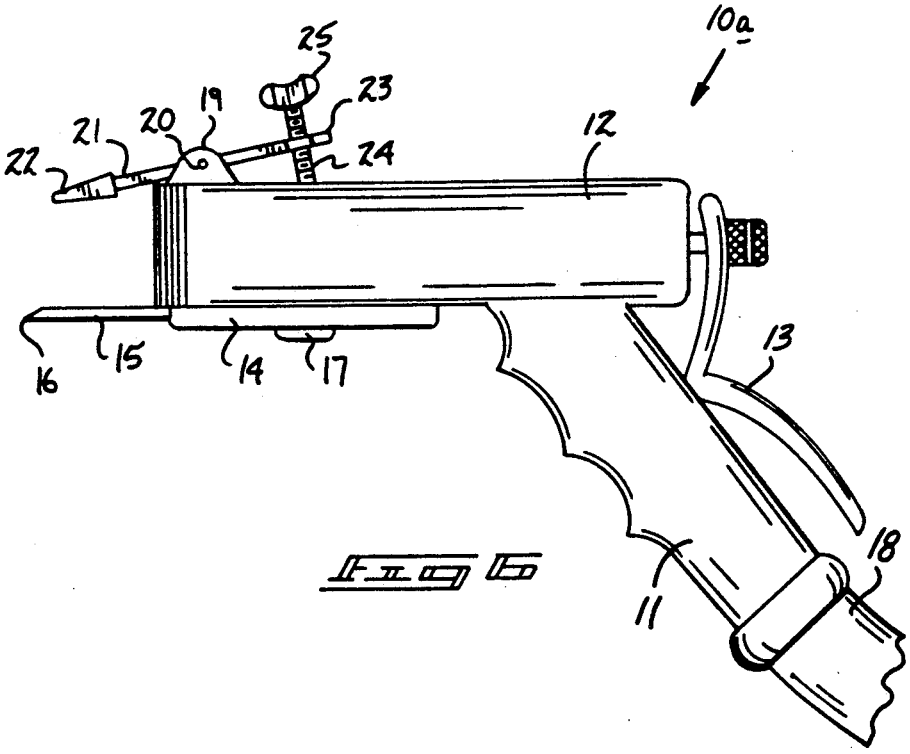
FIG. 6 is an orthographic side view, taken in elevation, of a modification of the instant invention.
Figure 11:
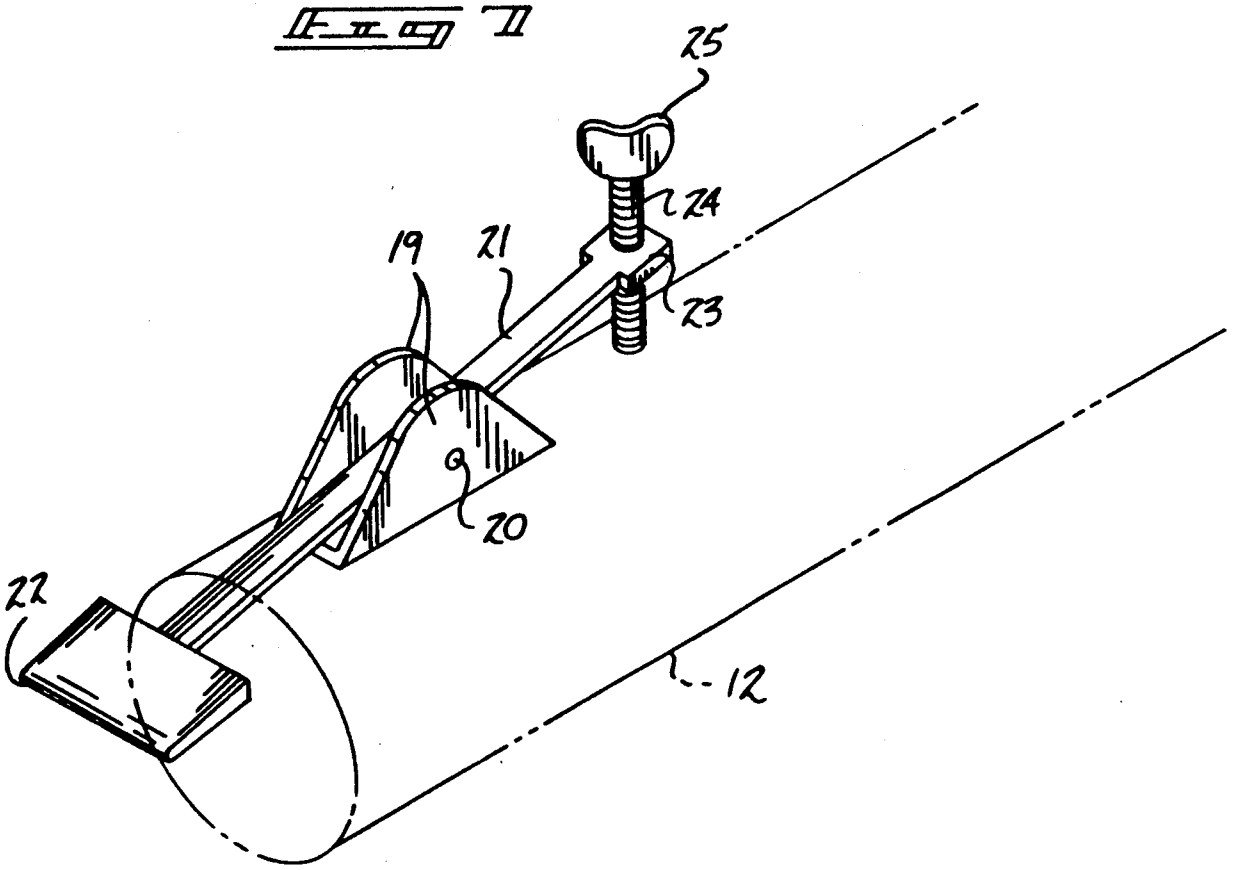

FIG. 6 illustrates a modified apparatus 10*a*, wherein additional structure is provided to enhance a directing of fluid spray in a fan-like array in cooperation with the slide blade 15. Specifically, a plurality of parallel ears 19 are mounted to the upper fluid conduit 12 adjacent the forward terminal end thereof diametrically opposed to the slide housing 14. An axle 20 is orthogonally directed through the ears 19 and pivotally mounts a lever blade 21. The lever blade includes a forward deflector plate 22 that is orthogonally mounted to the forward terminal end of the lever blade 21, with the deflector plate 22 positioned medially relative to the forward terminal end of the lever blade 21 and coplanar therewith. The deflector plate 22 extends laterally beyond each side of the blade 21 to enhance a fanning or water spread of fluid directed from the upper fluid conduit 12 and directs such fluid in a spray form in cooperation with the blade 15. It is noted that the lever blade 21 extends over and beyond the forward terminal end of the upper fluid conduit 12. A rear plate 23 is integrally mounted to the rear terminal end of the lever plate 21, and includes a threaded aperture directed therethrough. The threaded aperture receives a threaded adjustment rod 24 orthogonally through the rear plate 23, with a lower terminal end of the rod 24 in engagement with an upper surface of the upper fluid conduit 12, and an upper terminal end of the rod 24 including a grasping head 25, whereupon rotation of the rod 24 by the grasping head 25 radial permits intrusion diffusion of the deflector plate 22 overlying the outlet port of the upper fluid conduit 12 to adjust. In use, a fluid hose 18 is secured to the lower terminal end of the handle 11 in directing pressurized fluid through the handle and upper fluid conduit in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A fluid nozzle and scraper apparatus comprising, a handle, including a fluid conduit directed therethrough, and an upper fluid conduit mounted in fluid communication with the handle, and a valve member operatively associated with the handle and upper fluid conduit to effect selective fluid flow to the handle and upper fluid conduit, and a scraper blade means mounted to the upper fluid conduit adjacent a forward terminal end thereof permitting selective scraping during directing of fluid flow through the upper fluid conduit, and wherein the scraper blade means includes a slide housing, the slide housing mounted to a bottom surface of the upper fluid conduit and positioned adjacent the forward terminal end of the upper fluid conduit extending rearwardly therefrom, wherein the upper fluid conduit includes an upper conduit axis and wherein the slide housing is arranged parallel to the upper conduit axis, and the slide housing includes a slide blade reciprocatably mounted relative to the slide housing, and wholly contained within the slide housing in a first retracted position, and wherein the slide blade extends forwardly of the upper fluid conduit in a second extended position, and a blade button projecting through the housing and operatively associated with the slide blade to effect reciprocation of the slide blade relative to the slide housing, and further including water deflection means mounted to the upper fluid conduit in an orientation diametrically opposed to the slide housing for directing fluid spray to the slide blade when the slide blade is in the second position, and wherein the water deflection means includes a plurality of spaced parallel ears, the parallel ears fixedly mounted to the upper fluid conduit diametrically opposed to the slide housing and includes an axle oprthogonally directed through the parallel ears, the axle mounting a lever blade, with the lever blade extending rearwardly and forwardly of the axle, and a forward deflector plate mounted to a forward terminal end of the lever blade, the forward deflector plate extending laterally beyond the lever blade and positioned forwardly of the upper fluid conduit, wherein the lever blade is coplanar with the deflector plate, and wherein the lever blade further includes a rear plate, the rear plate integrally mounted to a rear terminal end of the lever blade, the rear plate including an internally threaded aperture, the internally threaded aperture threadedly receiving a threaded rod therethrough , the threaded rod including a lower terminal end in contact with the upper fluid conduit, and an upper terminal end of the rod including a grasping cap to permit manual rotation of the rod to permit radial adjustment of the deflector plate relative to the upper fluid conduit.

* * * * *